US006648049B2

(12) United States Patent
Bryant

(10) Patent No.: US 6,648,049 B2
(45) Date of Patent: Nov. 18, 2003

(54) CORD LOCK AND METHOD FOR ADJUSTING THE LENGTH OF A WINDOW BLIND ASSEMBLY

(76) Inventor: David C. Bryant, 5562 N. Elston Ave., Chicago, IL (US) 60630

( * ) Notice: Subject to any disclaimer, the term of this patent is extended or adjusted under 35 U.S.C. 154(b) by 0 days.

(21) Appl. No.: 10/024,951

(22) Filed: Dec. 19, 2001

(65) Prior Publication Data

US 2002/0074093 A1 Jun. 20, 2002

Related U.S. Application Data

(60) Provisional application No. 60/256,810, filed on Dec. 19, 2000.

(51) Int. Cl.[7] ..... E06B 9/324

(52) U.S. Cl. ..... 160/168.1 R; 160/178.2; 24/132 R

(58) Field of Search ..... 160/178.2 R, 168.1 R, 160/173 R; 24/132 R, 518, 134 R, 114.5; E06B 9/324, 9/326

(56) References Cited

U.S. PATENT DOCUMENTS

| | | | | |
|---|---|---|---|---|
| 1,878,186 | A | 9/1932 | Rudolph | |
| 2,071,791 | A | 2/1937 | Hendricks | 156/17 |
| 2,086,461 | A | 7/1937 | Bogan | 156/17 |
| 2,314,461 | A | 3/1943 | Schaefer | 160/173 |
| 2,416,530 | A | 2/1947 | Lidin | 160/115 |
| 2,502,028 | A | 3/1950 | Rosebaum | 160/178 |
| 2,561,141 | A | 7/1951 | Schaefer | 160/173 |
| 2,592,995 | A | 4/1952 | Anderle | 160/173 |
| 2,594,806 | A | 4/1952 | Rosenbaum | 160/173 |
| 2,598,575 | A | 5/1952 | Martin et al. | 160/178 |
| 2,616,496 | A | 11/1952 | Junkunc | 160/173 |
| 2,618,329 | A | 11/1952 | Nelson | 160/173 |
| 2,626,659 | A | 1/1953 | Wright et al. | 160/178 |
| 2,627,917 | A | 2/1953 | Lind | 160/173 |
| 2,697,487 | A | 12/1954 | Nelson | 160/173 |
| 2,756,816 | A | 7/1956 | Radel et al. | 160/173 |
| 2,771,135 | A | 11/1956 | Walker | 160/168 |
| 2,838,110 | A | 6/1958 | Lando | 160/163 |
| 2,861,631 | A | 11/1958 | Anderle | 160/173 |

(List continued on next page.)

FOREIGN PATENT DOCUMENTS

| | | | |
|---|---|---|---|
| DE | 20003853 | * | 6/2000 |
| FR | 1067458 | | 6/1954 |
| FR | 2347806 | | 11/1977 |
| JP | 2002-47873 | * | 8/2000 |

*Primary Examiner*—Blair M. Johnson
(74) *Attorney, Agent, or Firm*—Barnes & Thornburg

(57) ABSTRACT

A cord lock desirably for a window blind assembly adapted to be releasably locked to a cord, such as a vertical cord of the window blind assembly, at alternate locations along the length of the cord. The cord lock desirably includes a first member and a second member that are hingedly connected together in any suitable manner for opening and closing the cord lock. The cord lock defines a channel for receiving the cord and includes structure for engaging the cord within the channel to releasably lock the cord lock to the cord when the cord lock is in a closed position. The channel may be elongated and defined by the second member, and the cord engaging structure may be integral or otherwise associated with the first member. The cord may be received within the channel when the cord lock is in a closed position to lock the cord lock to the cord and desirably also to substantially enclose the channel so as to define a passage with two open ends. At least a portion of the channel may be enclosed to retain the cord within the channel and permit sliding of the cord lock along the cord even when the cord lock is in the open position. A method is also provided for adjusting the length of the window blind assembly including the step of releasably locking the cord lock to the cord of the window blind assembly.

26 Claims, 3 Drawing Sheets

U.S. PATENT DOCUMENTS

| | | | | | |
|---|---|---|---|---|---|
| 2,877,527 | A | * | 3/1959 | Bond | 403/206 |
| 2,884,052 | A | | 4/1959 | Lando et al. | 160/168 |
| 3,485,285 | A | | 12/1969 | Anderle | 160/168 |
| 3,727,665 | A | * | 4/1973 | Debs | 160/178.2 |
| 4,114,673 | A | | 9/1978 | de Wit et al. | 160/166 |
| 4,177,853 | A | | 12/1979 | Anderson et al. | 160/168 |
| 4,487,243 | A | | 12/1984 | Debs | 160/168 R |
| 4,635,698 | A | * | 1/1987 | Anderson | 160/178.2 |
| 4,638,166 | A | | 1/1987 | Baudro | 250/515.1 |
| 4,647,488 | A | | 3/1987 | Schnebly et al. | 428/116 |
| 4,675,060 | A | | 6/1987 | Schnebly et al. | 156/65 |
| 4,799,524 | A | | 1/1989 | Guermonprez | 160/84.1 |
| 4,886,102 | A | | 12/1989 | Debs | 160/168.1 |
| 4,955,420 | A | | 9/1990 | Marinescu et al. | 160/178.2 |
| 4,967,824 | A | * | 11/1990 | Colson et al. | 160/178.1 R |
| 5,058,650 | A | * | 10/1991 | Morris | 160/168.1 R |
| 5,285,838 | A | | 2/1994 | Rapp et al. | 160/168.1 |
| 5,485,875 | A | | 1/1996 | Genova | 160/168.1 |
| 5,562,140 | A | * | 10/1996 | Biba | 160/178.1 R |
| 5,655,590 | A | | 8/1997 | Bryant | 160/168.1 |
| 5,765,621 | A | | 6/1998 | Bryant | 160/168.1 R |
| 5,927,366 | A | | 7/1999 | Bryant | 160/168.1 R |
| 6,062,292 | A | | 5/2000 | Bryant | 160/178.1 R |

* cited by examiner

CORD LOCK AND METHOD FOR ADJUSTING THE LENGTH OF A WINDOW BLIND ASSEMBLY

This application claims the benefit of priority of U.S. Provisional Patent Application No. 60/256,810 filed on Dec. 19, 2000.

The present invention relates generally to a cord lock desirably for use with a cord of a window blind assembly or the like.

BACKGROUND

Most commercially available window blinds comprise a plurality of interconnected slats, a bottom rail and a head rail. The slats are usually interconnected by a pair of vertical cords that extend from the bottom rail, through the slats, into the head rail, outside an opening defined by the head rail, and then adjacent the slats. Within the head rail, each of the vertical cords engages a gear lock or other suitable mechanism that releasably engages and disengages the cord to facilitate ready adjustment of the length of the window blind assembly. Typically, the gear lock engages the cords in response to yanking or pulling of the cords in a direction thereby fixing the length of the window blind assembly; and disengages the cords in response to yanking or pulling of the cords in another direction thereby allowing the length of the window blind assembly to be adjusted.

The vertical cords, together with the gear lock within the head rail, are used to adjust the length of the window blind, e.g., to extend the window blind assembly to its normal or fully extended length, to retract the blind assembly to its retracted state, or to adjust the length of the window blind assembly to any desired length therebetween. Pulling the one or more vertical cords downward, for example, causes the window blind assembly to retract and, by then engaging the cords with the gear lock, the vertical cords can be releasably locked in place to retain the window blind assembly at the desired length. When the gear lock is manually unlocked, the window blind assembly can be lowered to a lower position or to the fully extended position.

The industry has come to recognize that, when the vertical cords are in their relaxed state, a typical window blind assembly poses a dangerous risk to infants and toddlers. Because there is little tension in the vertical cords in their relaxed state, the portions of the vertical cords between the interconnected slats can be easily pulled outwardly due to slack in the vertical cords and, of more concern, to create an opening through which a head or other body part can fit. Such opening poses a serious risk of strangulation or injury to an infant or toddler.

This dangerous condition can occur when the gear lock is inadvertently disengaged upon inadvertent application of a side force to the vertical cord. For example, an infant or toddler, playing with one or more of the vertical cords when the window blind assembly is retracted in whole or in part, may cause the gear lock to disengage causing the window blind assembly to fully extend or otherwise cause the vertical cords to be in a relaxed state.

SUMMARY

A cord lock adapted to be releasably locked to a cord, such as, for example, a cord of a window blind assembly, at adjustable locations along the length of the cord. The cord lock may include a first member and a second member hingedly connected together to enable the first member to pivot from an open position of the cord lock to a closed position of the cord lock for releasably locking the cord lock to the cord. In a preferred embodiment, the first and second members include locking structure for releasably locking the first and second members to the closed position. The locking structure may include a protrusion associated with the first member that is received within an opening defined by the second member. The second member desirably engages the protrusion by friction fit.

The cord lock also may include a hinge hingedly connecting the first and second members. In a preferred embodiment, the hinge comprises a hooking member associated with the first member and a pin associated with the second member, the hooking member engaging the pin to facilitate pivoting of the first member. The hinge may retain the cord within a portion of the channel when the cord lock is in the open position. The first and second members may comprise engaging structure for engaging the cord when the cord lock is in the closed position and may also comprise structure for releasably retaining the cord lock in the closed position.

Desirably, the cord lock defines a channel for receiving the cord. The cord lock may be adapted to retain the cord within at least a portion of the channel when the cord lock is in the open position.

A cord lock in accordance with a preferred embodiment may be a component of an extendible window blind assembly comprising a plurality of slats, a head rail, at least one cord interconnecting the slats, the cord extending from the slats through an opening defined by the head rail and adjacent the slats for adjusting the length of the window blind assembly. The cord lock is releasably lockable to the cord at adjustable locations along the length of the cord and is adapted to be positioned and releasably locked to the cord adjacent the opening to prevent any of the cord adjacent the slats from passing though the opening to the slats.

A method is also provided for adjusting the length of the extendible window blind assembly. The method includes the step of releasably locking the cord lock to the cord adjacent the opening to prevent a portion of the cord from passing through the opening. The method may also include the steps of releasably unlocking the cord lock, sliding the cord lock along the length of the cord adjacent the opening, and releasably locking the cord lock to the cord adjacent the opening to prevent a portion of the cord from passing through the opening.

Accordingly, in accordance with a preferred embodiment, when in the open position, the cord lock is engaged with the cord and can be readily moved along the length of the cord to a desired location. Once the cord lock is positioned at a desired location, the first and second members may be pressed together to cause the cord lock to close and lock at the desired location on the cord.

BRIEF DESCRIPTION OF DRAWINGS

The present invention and the advantages thereof will become more apparent upon consideration of the following detailed description when taken in conjunction with the accompanying drawings.

DETAILED DESCRIPTION OF THE PREFERRED EMBODIMENTS

Figure 1A:
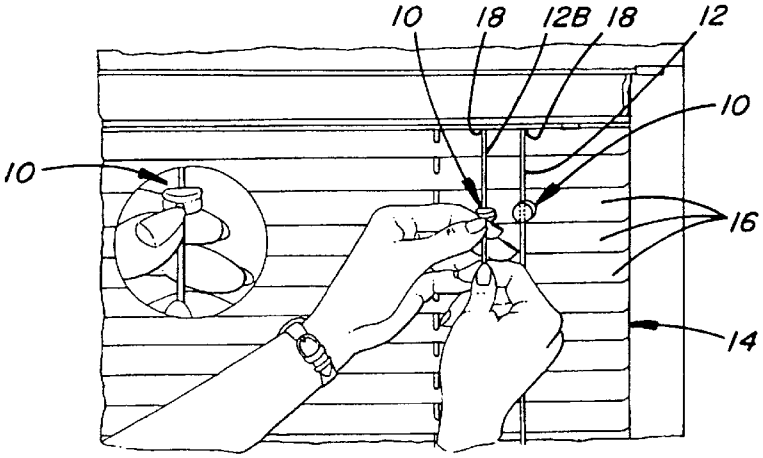
FIGS. 1A–1D are fragmentary drawings, schematic and instructional in nature, illustrating a cord lock in accordance with an embodiment of the invention being adjusted on a window blind assembly and including enlarged views of the cord lock for illustrative purposes.
Figure 1B:
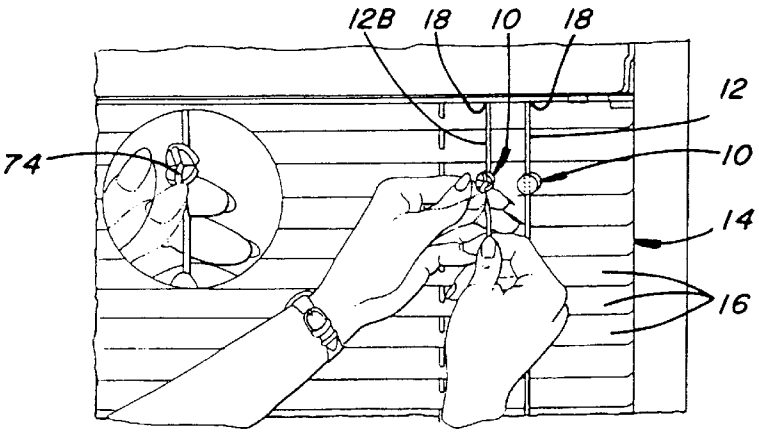
Figure 1C:
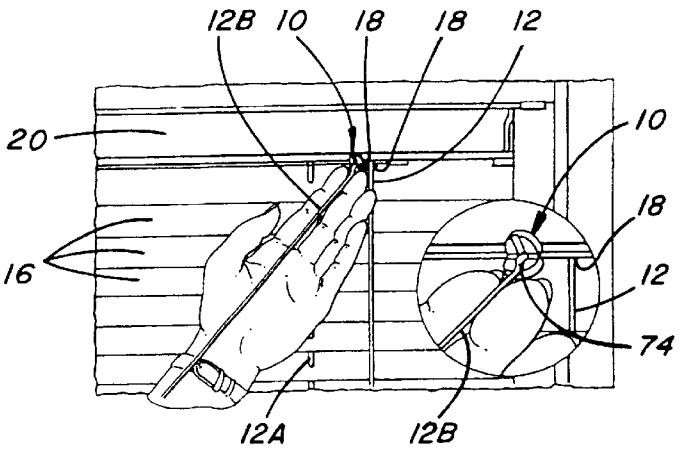
Figure 1D:
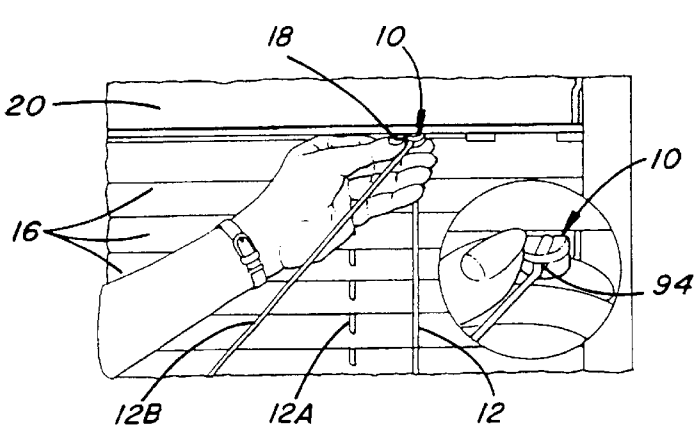
Figure 2C:
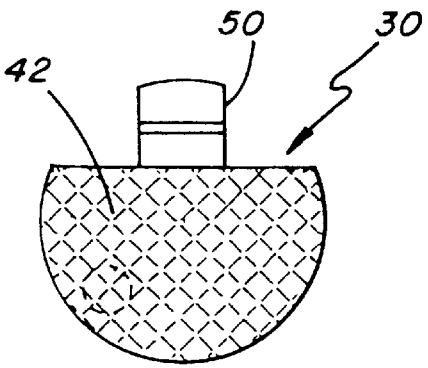
FIG. 2C is a plan view of the rear face of the member of FIG. 3.
Figure 2B:
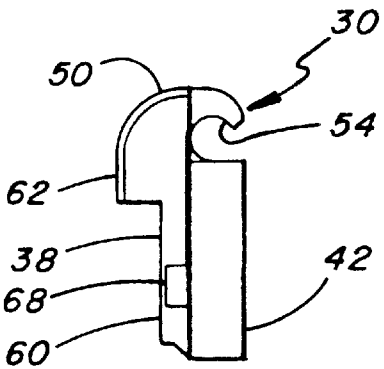
FIG. 2B is a side plan view of the member of FIG. 3.
Figure 2A:
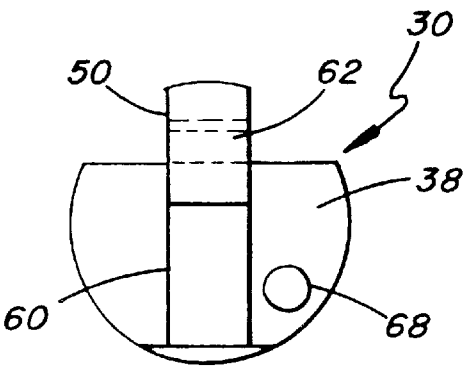
FIG. 2A is a plan view of the front face of one of the members of the cord lock in accordance with an embodiment of the invention.
Figure 3C:
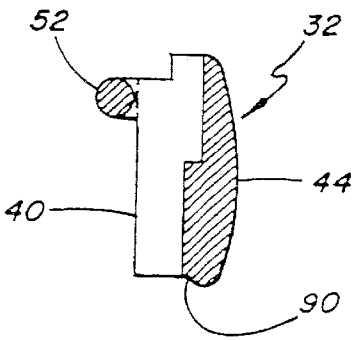
FIG. 3C is a cross-sectional view taken along the lines 3C—3C of FIG. 3A.
Figure 3D:
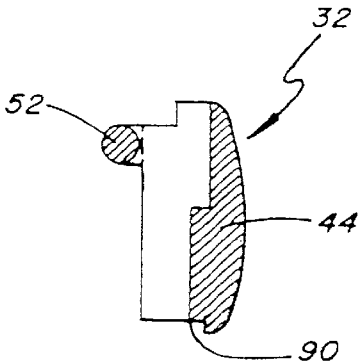
FIG. 3D is a view similar to FIG. 3C, illustrating an alternative embodiment of the other member of the cord lock.
Figure 3B:
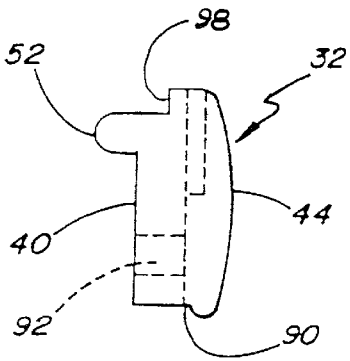
FIG. 3B is a plan view of one side of the member of FIG. 3A.
Figure 3A:
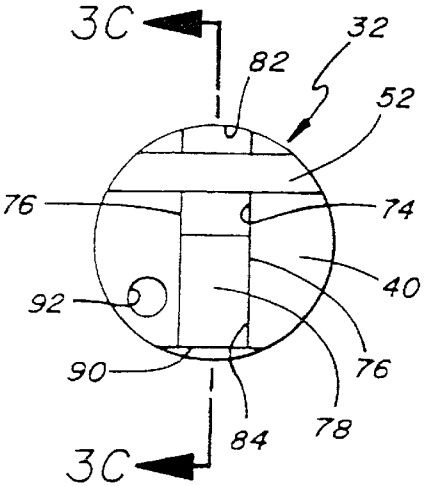
FIG. 3A is a plan view of the front face of the other member of the cord lock in accordance with an embodiment of the invention.

FIGS. 1A–3C illustrate generally a cord lock 10 in accordance with a preferred embodiment. FIGS. 1A–1D illustrate a pair of cord locks 10 engaged with a pair of vertical cords 12 of an adjustable window blind assembly 14 and being used to adjust the length of the window blind assembly. The illustrated window blind assembly 14 comprises a plurality of slats 16 interconnected by the pair of vertical cords 12, with each cord extending through the slats, upwardly through an opening 18 defined by a head rail 20 of the window blind assembly, and downwardly adjacent the slats. The portions 12*a* of the two cords 12 extending through the slats 16 may be spaced apart from each other across the width of the slats (only one such portion 12*a* is shown in FIGS. 1A–1D because they are fragmentary views). The portion 12*b* of the cords 12 extending adjacent the slats 14 are illustrated adjacent each other.

The cord lock 10 may have any suitable construction. The cord lock 10 in accordance with a preferred embodiment, for example, generally comprises a first member 30 and a second member 32 hingedly connected together to enable the cord lock to have an open position and a closed position. The first and second members 30 and 32 may have any suitable construction, may be hingedly connected in any suitable manner, and may be releasably securable together in any suitable manner.

In the illustrated embodiments, for example, the first and second members 30 and 32 each include a front engaging face 38 and 40 and a rear face 42 and 44. The illustrated hinge is in the form of a hinge hooking member 50 formed on the first member 30, and a hinge pin 52 formed on the second member 32 and received by an opening 54 defined by the hinge hooking member. The hinge hooking member 50 engages the hinge pin 52 to permit pivoting of the first member relative to the second member 32. The first and second members 30 and 32 may alternatively be hingedly connected by a living hinge or by any other suitable structure.

The first member 30 desirably is generally disk shaped except that is truncated, with the hinge hooking member 50 extending into the truncated area. An elongated generally rectangular protrusion 60 extends on and across the front face 38 of the first member 30 and terminates at the hinge hooking member 50. The hinge hooking member 50 includes an enlarged portion 62 desirably contiguous with the elongated protrusion 60. The front face 38 of the first member 30 may include an engaging stem 68 or other protrusion.

The second member 32 desirably is generally disk shaped, and defines an elongated channel 74 for receiving the cord. The channel 74 is defined by a pair of opposed walls 76 and a bottom wall 78, and, when the cord lock is in the open position, is substantially open across the front face 40 of the second member 32 except that the hinge pin 52 desirably extends perpendicularly across the channel to retain the cord within the channel. The channel 74 extends across the front face 40 of the second member 32 such that the first open end 82 of the channel desirably is adjacent the hinge pin 52 and the second open end 84 of the channel desirably is 180 degrees apart from the first end of the channel. The second member 32 may define a void 90 adjacent the second end 84 of the channel 74 for receiving a finger nail (including a thumb nail) or tool, for example, to facilitate prying open of the cord lock 10. The void 90 may have any suitable configuration (see e.g. FIGS. 3C and 3D). The front face 40 of the second member 32 defines a hole 92 for receiving the stem 68 of the first member 30.

When the cord lock 10 is in the closed position, the channel 74 of the second member 32 receives the elongated protrusion 60 of the first member 30 and the enlarged portion 62 of the first member 32, and the hole 92 of the second member receives the stem 68 of the first member 32. Desirably, in the closed position, the second member is engaged with the elongated protrusion 60 and the enlarged portion 62 within the channel 74 and with the stem 68 within the hole 92, by friction fit, to releasably lock together the first and second members 30 and 32.

Thus, in a preferred embodiment, when the cord lock 10 is in the closed position, it is releasably locked to the cord 12 desirably by the elongated protrusion 60 of the first member 30 and the enlarged portion 62 of the hinge hooking member 50. The elongated protrusion 60 and the enlarged portion 62 also enclose the channel 74 to form an enclosed passage 94 having the two open ends 82 and 84, through which the cord extends. The elongated protrusion 60 and the enlarged portion 62 of the hinge hooking member 50 desirably contact, and together with the second member 32, squeeze, pinch or otherwise lock the cord in place within the passage.

To open the cord lock 10, a user desirably may pry open the cord lock by, for example, sticking a finger nail into the void 90 defined by the second member 32 and then pivoting the first member 30 relative to the second member. Desirably, the first member 30 pivots 180° relative to second member 32. In this regard, the front face 40 of the second member 32 defines a void 98 to permit 180° pivoting. When the cord lock 10 is in the open position, the cord lock is free to slide relative to the cord 12 and desirably remains engaged with the cord so that it can slide to the desired location along the length of the cord. The cord desirably is maintained within the channel 74 when the cord lock 10 is in the open position by, for example, the hinge pin 52 or any other suitable structure.

Once the cord lock 10 is moved to the desired location along the length of the cord 12, it can be closed desirably by squeezing together the first and second members 30 and 32. Thus, the cord lock 10 is releasably locked to the cord at the desired location and desirably cannot move or slide relative to the cord.

As illustrated in FIG. 1, cord locks 10 in accordance with a preferred embodiment can be used, for example, in connection with vertical cords 12 of a window blind assembly 14. The cord lock 10 can be readily positioned and locked to the respective vertical cord 12 adjacent the opening 18 of the head rail 20 such that it prevents the window blind assembly 14 from extending. The length of the window blind assembly 14 can thereafter be easily adjusted by opening the one or more cord locks 10, extending or retracting the window blind assembly 14 to the desired position, sliding the one or more cord locks along the respective vertical cords 16 to be adjacent the head rail 20 and then closing the one or more cord locks to releasably lock to the respective vertical cords adjacent the head rail opening 18.

Accordingly, the present invention also provides a method for adjusting the length of the window blind assembly 14. When the window blind assembly 14 is positioned at a desired length, the user unlocks the cord lock 10, slides it to a desired position along the length of the cord 12, releasably locks the cord lock in place. This method desirably is repeated with the other cord lock. In the embodiment illustrated in FIGS. 1A–1D, for example, a finger nail is inserted into the void 90 defined by the first and second members 30 and 32 (see, e.g., FIGS. 1A and 1B). The unlocked cord lock 10 is slidingly moved along the length of the portion 12*b* of the respective vertical cord adjacent the slats 16 and positioned adjacent the opening 18 (see, e.g., FIG. 1C). The first and second members 30 and 32 are squeezed together to releasably lock the cord lock 10 to the respective vertical cord to prevent the portion 12*b* of the respective vertical cord from passing through the opening.

The cord lock 10 may be constructed of any suitable material, such as, for example, plastic. If desired, the plastic may be a clear plastic so as to not affect the aesthetic appearance of the window blind assembly. If desired, a portion of the cord lock, such as for example rear face 42 of the first member 30, may be frosted or sanded so that the otherwise clear plastic cord lock can be located quickly if it is dropped on the floor or otherwise misplaced (see, e.g. FIG. 2C).

The cord lock in accordance with a preferred embodiment provides many advantages. For example, it can be used in connection with a vertical cord of a window blind assembly, and it can be readily positioned and locked to the vertical cord adjacent an opening of the head rail such that it prevents the window blind assembly from extending further. The length of the window blind assembly can be easily adjusted by opening the cord locks, extending or retracting the window blind assembly to the desired position, sliding the one or more cord locks along the respective vertical cords to be adjacent the head rail opening, and then closing the cord locks to releasably lock to the respective cords adjacent the head rail opening.

Thus, in accordance with a preferred embodiment, the cord lock can be used to eliminate or substantially reduce the risk of strangulation that is otherwise present because it eliminates the possibility that tension in the vertical cords will be reduced in response to inadvertent yanking or pulling of the vertical cords. For example, an infant or toddler playing with the cords is not likely to disengage the cord locks because they are securely engaged up at the headrail.

While a preferred embodiment is shown and described, those skilled in the art may devise various modifications and equivalents without departing from the spirit and scope of the invention as recited in the following claims.

What is claimed:

1. An extendible window blind assembly comprising a plurality of slats, a head rail, at least one cord interconnecting the slats, the at least one cord extending from the slats through an opening defined by the head rail and adjacent the slats for adjusting the length of the window blind assembly, and a cord lock releasably lockable to no more than one of the at least one cord at adjustable locations along the length of said no more than one cord, the cord lock adapted to be positioned and releasably locked to said no more than one cord adjacent the opening to prevent any of said no more than one cord adjacent the slats from passing though the opening to the slats.

2. The extendible window blind assembly of claim 1 wherein the cord lock defines a channel for receiving said no more than one cord, the cord lock comprising a first member and a second member hingedly connected together to enable the first member to pivot from an open position of the cord lock to a closed position of the cord lock for releasably locking the cord lock to said no more than one cord.

3. The extendible window blind assembly of claim 2 wherein the first and second members include locking structure for releasably locking the first and second members together when the cord lock is in the closed position.

4. An extendible window blind assembly comprising a plurality of slats, a head rail, at least one cord interconnecting the slats, the cord extending from the slats through an opening defined by the head rail and adjacent the slats for adjusting the length of the window blind assembly, and a cord lock releasably lockable to the cord at adjustable locations along the length of the cord, the cord lock adapted to be positioned and releasably locked to the cord adjacent the opening to prevent any of the cord adjacent the slats from passing though the opening to the slats;

wherein the cord lock defines a channel for receiving the cord, the cord lock comprising a first member and a second member hingedly connected together to enable the first member to pivot from an open position of the cord lock to a closed position of the cord lock for releasably locking the cord lock to the cord; and wherein the locking structure comprises a protrusion associated with the first member that is received within a hole defined by the second member.

5. The extendible window blind assembly of claim 4 wherein the second member engages the protrusion by friction fit.

6. The extendible window blind assembly of claim 2 wherein the cord lock further comprises a hinge hingedly connecting the first and second members.

7. An extendible window blind assembly comprising a plurality of slats, a head rail, at least one cord interconnecting the slats, the cord extending from the slats through an opening defined by the head rail and adjacent the slats for adjusting the length of the window blind assembly, and a cord lock releasably lockable to the cord at adjustable locations along the length of the cord, the cord lock adapted to be positioned and releasably locked to the cord adjacent the opening to prevent any of the cord adjacent the slats from passing though the opening to the slats;

wherein the cord lock defines a channel for receiving the cord, the cord lock comprising a first member and a second member hingedly connected together to enable the first member to pivot from an open position of the cord lock to a closed position of the cord lock for releasably locking the cord lock to the cord;

wherein the cord lock further comprises a hinge hingedly connecting the first and second members; and wherein the hinge comprises a hooking member associated with the first member and a pin associated with the second member, the hooking member engaging the pin to facilitate pivoting of the first member.

8. The extendible window blind assembly of claim 2 wherein the cord lock is adapted to retain said no more than one cord within at least a portion of the channel when the cord lock is in the open position.

9. The extendible window blind assembly of claim 2 wherein the cord lock further comprises a hinge hingedly connecting the first and second members, the hinge retaining said no more than one cord within a portion of the channel when the cord lock is in the open position.

10. The extendible window blind assembly of claim 2 wherein the first and second members comprise engaging structure for engaging said no more than one cord when the cord lock is in the closed position.

11. The extendible window blind assembly of claim 2 wherein the cord lock comprises structure for engaging said no more than one cord when the cord lock is in the closed position and for releasably retaining the cord lock in the closed position.

12. The extendible window blind assembly of claim 2 wherein at least one of the first and second members defines a void when the cord lock is in the closed position for receiving a finger nail for pivoting the first member to the open position of the cord lock.

13. A method for adjusting the length of an extendible window blind assembly comprising a plurality of slats, a head rail, at least one cord interconnecting the slats and extending from the slats through an opening defined by the head rail and adjacent the slats for adjusting the length of the window blind, the method comprising the step of releasably locking a cord lock to no more than one of the at least one cord adjacent the opening to prevent a portion of said no more than one cord from passing through the opening.

14. A method for adjusting the length of an extendible window blind assembly comprising a plurality of slats, a head rail, at least one cord interconnecting the slats and extending from the slats through an opening defined by the head rail and adjacent the slats for adjusting the length of the window blind, the method comprising the steps of releasably unlocking a cord lock engaged with no more than one of the at least one cord, sliding the cord lock along the length of said no more than one cord adjacent the opening, and releasably locking the cord lock to said no more than one cord adjacent the opening to prevent a portion of said no more than one the cord from passing through the opening.

15. An extendible assembly for positioning adjacent a window comprising an extendible portion, a head rail, at least one vertical cord associated with the extendible portion and extending through an opening defined by the head rail for adjusting the length of the extendible portion, and a cord lock releasably lockable to no more than one of the at least one cord at adjustable locations along the length of said no more than one cord, the cord lock adapted to be positioned and releasably locked to said no more than one cord adjacent the opening to prevent any of said no more than one cord adjacent the extendible portion from passing though the opening.

16. The extendible assembly of claim 15 wherein the cord lock defines a channel for receiving said no more than one cord, the cord lock comprising a first member and a second member hingedly connected together to enable the first member to pivot from an open position of the cord lock to a closed position of the cord lock for releasably locking the cord lock to said no more than one cord.

17. The extendible assembly of claim wherein the first and second members including locking structure for releasably locking the first and second members together when the cord lock is in the closed position.

18. The extendible assembly of claim 16 wherein the cord lock further comprises a hinge hingedly connecting the first and second members.

19. The extendible assembly of claim 16 wherein the cord lock is adapted to retain said no more than one cord within at least a portion of the channel when the cord lock is in the open position.

20. The extendible assembly of claim 16 wherein the cord lock further comprises a hinge hingedly connecting the first and second members, the hinge retaining said no more than one cord within a portion of the channel when the cord lock is in the open position.

21. The extendible assembly of claim 16 wherein the first and second members comprise engaging structure for engaging said no more than one cord when the lock is in the closed position.

22. The extendible assembly of claim 16 wherein the cord lock comprises structure for engaging said no more than one cord when the lock is in the closed position and for releasably retaining the cord lock in the closed position.

23. The extendible assembly of claim 16 wherein at least one of the first and second members defines a void when the cord lock is in the closed position for receiving a finger nail for pivoting the first member to the open position of the cord lock.

24. An extendible assembly for positioning adjacent a window comprising an extendible portion, a head rail, at least one vertical cord associated with the extendible portion and extending through an opening defined by the head rail for adjusting the length of the extendible portion, and a cord lock releasably lockable to the cord at adjustable locations along the length of the cord, the cord lock adapted to be positioned and releasably locked to the cord adjacent the opening to prevent any of the cord adjacent the extendible portion from passing though the opening;

wherein the cord lock defines a channel for receiving the cord, the cord lock comprising a first member and a second member hingedly connected together to enable the first member to pivot from an open position of the cord lock to a closed position of the cord lock for releasably locking the cord lock to the cord; and wherein the locking structure comprises a protrusion associated with the first member that is received within a hole defined by the second member.

25. The extendible assembly of claim 24 wherein the second member engages the protrusion by friction fit.

26. An extendible assembly for positioning adjacent a window comprising an extendible portion, a head rail, at least one vertical cord associated with the extendible portion and extending through an opening defined by the head rail for adjusting the length of the extendible portion, and a cord lock releasably lockable to the cord at adjustable locations along the length of the cord, the cord lock adapted to be positioned and releasably locked to the cord adjacent the opening to prevent any of the cord adjacent the extendible portion from passing though the opening;

wherein the cord lock defines a channel for receiving the cord, the cord lock comprising a first member and a second member hingedly connected together to enable the first member to pivot from an open position of the cord lock to a closed position of the cord lock for releasably locking the cord lock to the cord;

wherein the cord lock further comprises a hinge hingedly connecting the first and second members; and wherein the hinge comprises a hooking member associated with the first member and a pin associated with the second member, the hooking member engaging the pin to facilitate pivoting of the first member.

* * * * *